United States Patent [19]

Hooper

[11] 4,267,982

[45] May 19, 1981

[54] BARK SHREDDER

[75] Inventor: Anthony W. Hooper, Montreal, Canada

[73] Assignee: Uniweld Inc., West Sherbrooke, Canada

[21] Appl. No.: 13,814

[22] Filed: Feb. 22, 1979

[51] Int. Cl.[3] ..... B02C 18/18

[52] U.S. Cl. ..... 241/257 R; 241/285 A; 241/285 B

[58] Field of Search ..... 241/188 R, 188 A, 191, 241/189 A, 190, 257 R, 261, 260, 285 R, 285 A, 285 B

[56] References Cited

U.S. PATENT DOCUMENTS

| | | | |
|---|---|---|---|
| 8,072 | 5/1851 | Vanderslice | 241/261 X |
| 2,492,872 | 12/1949 | Knight | 241/189 A X |
| 3,652,023 | 3/1972 | Wood | 241/191 X |

FOREIGN PATENT DOCUMENTS

| | | | |
|---|---|---|---|
| 361464 | 5/1962 | Switzerland | 241/189 A |

OTHER PUBLICATIONS

Bark Shredder, Hooper, A. W., 1-1975.

*Primary Examiner*—Mark Rosenbaum
*Attorney, Agent, or Firm*—Larson, Taylor and Hinds

[57] ABSTRACT

A bark shredder is disclosed for shredding bark and other waste wood products into small pieces. The shredder rotates in either direction unlike existing bark shredders which allows twice the normal operating time between servicing. The shredder has a casing defining a cylindrical working chamber with a top inlet and a bottom symmetrical outlet. A rotor is mounted axially in the chamber and a plurality of fixed shredding elements are attached to the casing in a circle at one level of the chamber intermediate the inlet and outlet, the fixed elements extend radially inwards. The rotor has a plurality of rotating shredding elements pivotally attached thereto and located above but adjacent to the fixed elements. The fixed and rotating elements are shaped to co-operate with each other to shred material in the chamber when the rotor is rotated in either direction.

13 Claims, 6 Drawing Figures

BARK SHREDDER

This invention relates to shredding bark and other waste wood products into small pieces and more particularly relates to an improved device for shredding, the device being defined as a bark shredder.

Bark shredders for shredding long pieces of bark waste veneers, forest residues, oversize chips, large organic materials and organic wastes are well known. The known bark shredders use a tubular casing having a set of fixed shredding elements therein. A rotor is also mounted in the casing, the rotor having rotating shredding elements thereon which cooperate with the fixed shredding elements to shred materials fed into the casing when the rotor is rotated.

In these existing bark shredders, the rotor is arranged to turn in one direction only, and shredding only occurs when the rotating elements engage with the fixed elements in one direction. Thus, it is found that the shredding elements become worn fairly quickly and require frequent replacement. The cost of replacement is high because the fixed elements are generally welded to the inside of the casing and maintenance personnel must work inside the casing.

Another disadvantage of known shredders is that the casing wears out rapidly in the particular area adjacent the fixed shredding elements. A wear liner may be used to protect the casing in this high wear area, but the liner itself then needs frequent replacement. A great deal of the wear in the liner is highly localized in the area adjacent the shredding elements and when this area wears out, the entire liner must be replaced.

It is therefore a purpose of the present invention to provide an improved bark shredder which has a longer life and requires less maintenance than known bark shredders. It is another purpose of the present invention to provide an improved bark shredder which is easier to maintain than known shredders. It is a further purpose of the present invention to provide an improved bark shredder which requires less frequent replacement of parts.

In accordance with the present invention, a bark shredder is provided with shredding elements that operate when the rotor is rotated in either direction. When the shredder elements of the present invention become worn after rotor rotation in one direction, the rotor rotation is reversed to use unworn portions of the shredder elements. Thus the life of the shredding elements is effectively doubled before replacement is required.

The bark shredder of the present invention is constructed to improve maintenance. A multi-part tubular casing is provided with the fixed shredding elements sometimes known as anvils mounted between upper and lower casing parts by bolts. Replacement of the fixed shredding elements is thus simplified. The rotating shredding elements sometimes referred to as knives are pivotally mounted to the rotor by pivot pins and held in the cutting position by centrifugal force. The casing is provided with a large service opening to replace the rotating shredder elements without disassembling the complete bark shredder. The large service opening is provided in the upper casing part to give easy access to the rotating shredding elements. In previous types of bark shredders the join between upper and lower casing was above the fixed shredding elements and thus the size of service openings was restrained by the existing design and height of the upper casing.

A further improvement in the bark shredder is the provision of liners in the upper and lower casing parts which results in longer life and reduces maintenance. The liners are in the form of removable annular rings positioned at the region of highest wear. More particularly the removable liner rings are made symmetrical and are at least twice the height of the region of highest wear, and thus when wear occurs in one area the rings are taken out, reversed and replaced so they have double the life of a normal liner. The liners are held to the casing by bolts or in some cases may be plug welded to the casing.

The present invention provides a bark shredder comprising a casing with a cylindrical working chamber, which has a top inlet and a bottom symmetrical outlet. A rotor is axially mounted in the chamber, and a plurality of fixed shredding elements are attached to the casing in a circle at one level of the chamber intermediate the inlet and outlet. The fixed shredding elements extend radially inwards from the casing into the chamber. A plurality of rotating shredding elements are pivoted to the rotor in a circle and are located above but adjacent to the fixed shredding elements. The rotating shredding elements extend radially outward from the rotor. The fixed and rotating shredding elements are shaped to co-operate with each other to shred material in the chamber when the rotor is rotated in either direction.

In another embodiment, the fixed and rotating shredding elements are made to be symmetrical about a line extending radially from the longitudinal axis of the chamber. Furthermore, in another embodiment the casing of the shredder comprises a top tubular part and a bottom tubular part, detachably joined together, with the fixed shredding elements detachably mounted between the two parts.

In a still further embodiment, a service opening is provided in the top part of the casing for use in servicing the shredding elements from the exterior. A curved door is mounted on the top part to close the service opening.

Yet another embodiment provides a shredder with a wear liner mounted within the casing in the area of the shredding elements to protect the casing. The wear liner has a plurality of removable annular rings which are mounted in the casing.

In drawings which illustrate embodiments of the invention,

Figure 1:
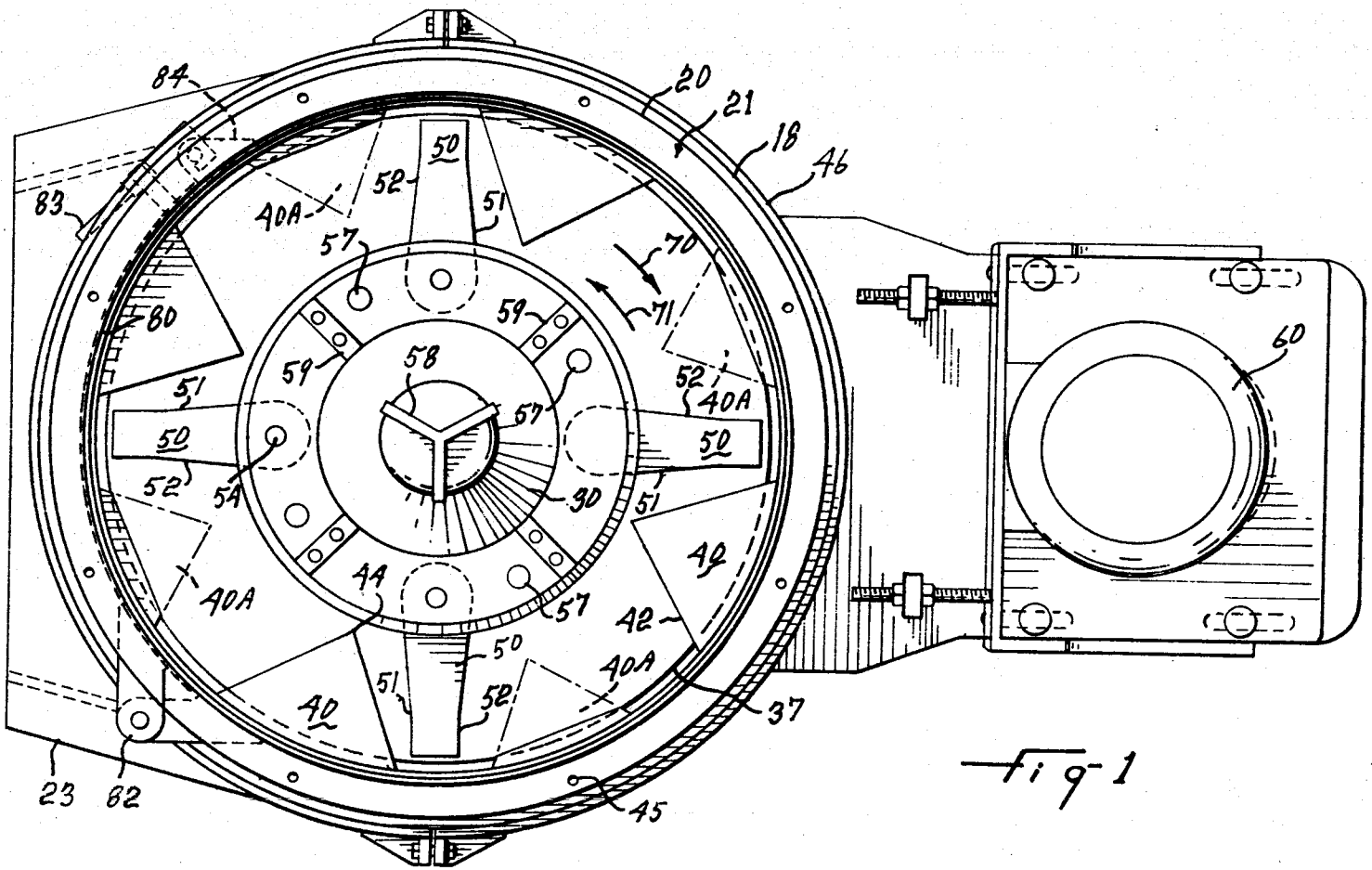
FIG. 1 is a plan view of one embodiment of a bark shredder of the present invention.
Figure 2:
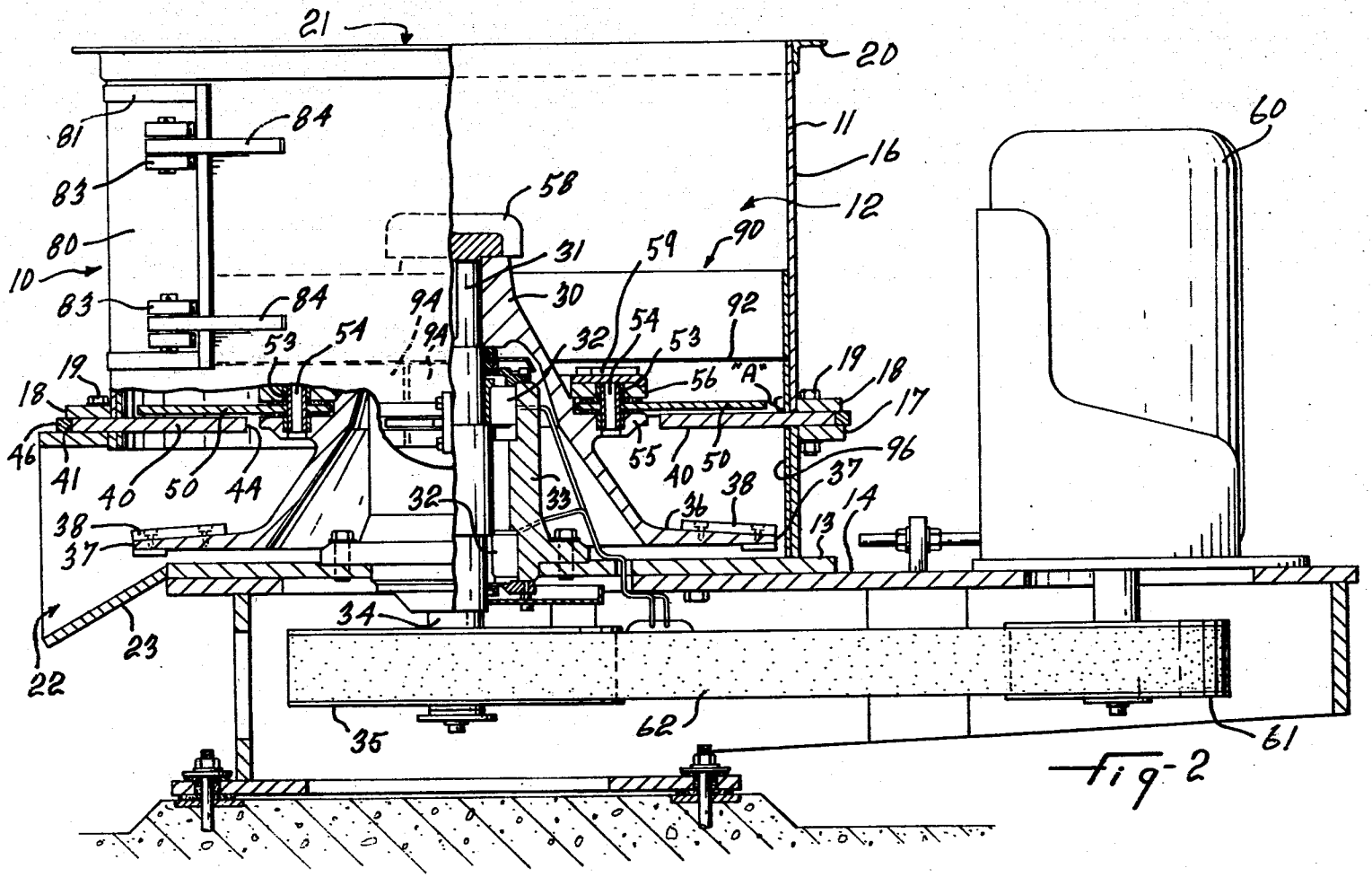
FIG. 2 is a cross section taken along line 2—2 of FIG. 1.

Referring now to FIGS. 1 and 2, the bark shredder 10 has a tubular main casing 11 which defines a cylindrical working or shredding chamber 12. The main casing 11 is mounted on a horizontal support plate 13 which in turn is mounted on a hollow shredder base 14. The main casing 11 is preferably tubular in shape and is mounted on the support plate 13 with its axis extending vertically upwards. The main casing 11 is divided into two parts, a bottom tubular casing part 15 fixed to plate 13, and a top tubular casing part 16 which is detachably fastened to the bottom casing part 15. A bottom fastening rim 17 extends around the top of the outside of the bottom casing part 15 and a top fastening rim 18 extends around the bottom of the outside of top casing part 16. Bolts 19 detachably connect the top and bottom casing parts 15, 16 together, at their first and second fastening rims 17, 18.

The top edge 20 of main casing 11 is open defining an inlet 21, for the bark to enter the working chamber 12. An outlet 22 is provided at the bottom of the main casing 11, in the lower casing part 15 adjacent the support plate 13, for removal of shredded bark from the chamber 12. A symmetrical exit chute 23, which operates when the rotor is rotating in either direction is fastened to the bottom casing part 15 and directs shredded bark radially away from main casing 11 through the outlet 22.

A rotor 30 is axially mounted within chamber 12. The rotor 30 is fastened to a shaft 31 which shaft is rotatably mounted in bearings 32 supported in housing 33. The housing 33 is fixed to the support plate 13. The upper end of the shaft 31 projects up from the housing 33 and the rotor 30 is firmly attached to the shaft 31. A lower driving end 34 of the shaft 31 projects below the support plate 13 into the hollow base 14. A pulley 35 is mounted on the shaft driving end 34 within the base 14. The rotor 30 has a generally conical shape and extends down and over the bearing housing 33. The bottom of rotor 30 flares outwardly into a circular skirt 36 which lies approximately parallel to, and just above, the support plate 13. The outer peripheral edge 37 of skirt 36 lies closely adjacent to the inner surface of the bottom casing part 15. A plurality of radially extending paddles 38 can be mounted on the top surface of skirt 36 to assist in flinging shredded bark out of the bottom of the chamber 12 through outlet 22.

A fixed set of bark shredding elements 40 are mounted on the main casing 11 within the chamber 12. The fixed shredding elements 40 are mounted on the same level within the chamber 12 and are arranged in spaced-apart relation in a circle, extending inwardly toward the rotor 30. Each fixed element 40 comprises a flat plate having a generally isosceles triangular shape with the base edge 41 of the triangular plate located at the main casing 11 and the straight cutting sides 42, 43 of the fixed element 40 meeting at a peak 44 located near the rotor 30. Preferably, each fixed element 40 is mounted between the bottom and top casing parts 15, 16 with its base edge 41 located between the rims 17, 18. Bolts 19 which connect the casing parts 15, 16 together pass through the fixed elements 40 adjacent their base edge 41 to lock the fixed elements 40 in place between the rims 17, 18. Bolts 19 which hold the top rim 18 and bottom rim 17 together also locate and hold each fixed element 40 in place. Jack screws 45 in the bottom rim 17 between the fixed elements 40 are provided to press against the top rim 18 and provide a space between the rims in order to remove and replace the fixed elements. In accordance with the present invention each fixed element 40 is symmetrical in shape about a line which extends radially from the axis of the chamber 12 through the peak 44 of the fixed element 40. A split ring 46 extends around the base of the fixed elements 40 between the rims 17, 18 closing the space between the fixed elements 40 and preventing the fixed elements from being knocked out of position. Four large fixed shredding elements 40 are shown with smaller fixed elements 40A in chain dotted lines between the large elements 40. The arrangement of fixed elements 40 may be varied to suit the particular material to be passed through the shredder, and also may depend on the diameter of the shredder.

The rotor 30 carries a rotating set of shredding elements or blades 50 which co-operate with the fixed shredding elements 40 to shred materials. The rotating elements 50 are equally spaced about rotor 30 and project radially outwardly therefrom towards the main casing 11. The rotating elements 50 are mounted in a circle at a level just above the fixed elements 40. Again, in accordance with the present invention each rotating element 50 is symmetrically shaped with respect to a line bisecting the element which line extends radially outwardly from the axis of the chamber 12. Each rotating element 50 comprises a generally flat, elongated plate having a pair of long cutting sides 51, 52 which are shown substantially parallel but may be tapered as desired. Each rotating element 50 is mounted at one end on a bushing 53 and a pin 54 which in turn is fixed on an annular shoulder 55 of the rotor 30. The rotating element 50 may pivot backwards and forwards on the pin 54 but generally retains the position shown in FIG. 1 when the rotor 30 is rotating due to centrifugal force. A retaining ring 56 and a series of bolts 57 hold the rotating elements 50 in place on the rotor 30. The outside free tip of each rotating element 50 extends to within a short distance of the inner surface of the top casing part 15. Four rotating elements 50 have been shown but more may be used if desired. A three vane flinger 58 is mounted on the top of the rotor 30 to fling material entering the inlet 21 towards the casing 11 and allow the material to fall towards the shredding elements. Further flinger guides 59 are mounted on the retaining ring 56 to aid in throwing material towards the casing 11.

The rotor 30 is rotated within the chamber 12 by a motor 60 mounted on the hollow shredder base 14 which motor 60 drives a pulley 61 connected to the rotor pulley 35 by belts 62 within the hollow base 14.

Since the fixed elements 40, rotating elements 50 and exit chute 23 are all symmetrical, the rotor 30 can be rotated in either direction to shred bark between the fixed and rotating elements thus doubling the life of the elements. When the rotor 30 is rotated in one direction shown by arrow 70, the generally straight edge 51 of each rotating element 50 co-operates with the angled edge 43 of each fixed element 40 to shred material. When the rotor 30 is rotated in the opposite direction shown by arrow 71, the other generally straight edge 52 of each rotating element 50 co-operates with the other angled edge 42 of each fixed element 40 to shred material.

The fixed elements 40 are easily replaced when necessary without removing the top casing part 16. All that is necessary is to remove the bolts 19 which hold the fixed elements 40 in place between the top rim 18 and the bottom rim 17, and then turn the jack screws 45 to raise the top casing part 16. The split rim 46 is removed and the fixed elements can be replaced. A large service door 80 is provided in the top casing part 16 for use in servicing the rotating elements 50. The door extends for 90° around the rim of the top casing part 16 and is large enough to allow access to the chamber for replacing the rotating elements 50. The door 80 is curved to match the curvature of the top casing part 16 and closes a service opening 81 therein. The door 80 is mounted on one side by hinges 82 to the top casing part 16 adjacent one side of the opening 81. The other side of the door 80 has locking means 83 thereon which co-operate with locking means 84 on the top casing part 16 adjacent the other side of opening 81 to lock the door 80 in a closed position. The door 80 is sufficiently large enough for a man to lean in and replace the rotating elements 50 without having to remove the upper casing section 16.

Figure 3:
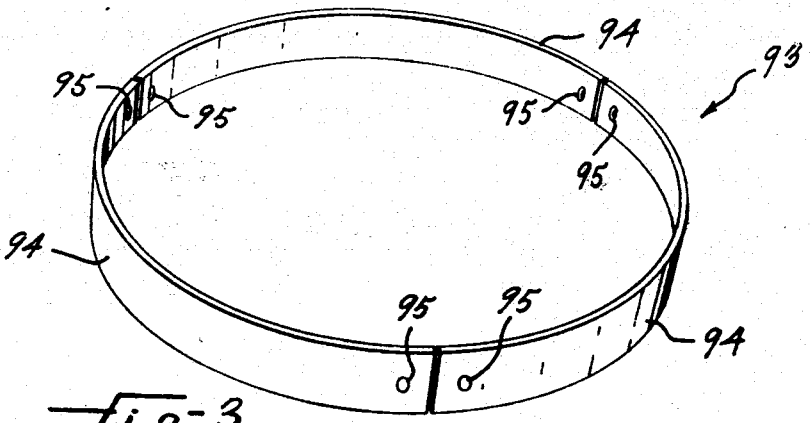
FIG. 3 is an isometric view of a three sector annular ring removable liner for a bark shredder of the present invention.

To minimize wear of the casing 11 in the shredding zone of the chamber 12 adjacent and near the fixed elements 40 and rotating elements 50, a cylindrical liner 90 is provided within the casing adjacent the inner surface of the casing. The liner 90 has a length generally equal to the height of the rotor 30 and is positioned within the casing 11 opposite to the rotor 30. In accordance with one embodiment of the present invention, the liner 90 is divided into three annular ring liners. The greatest wear area of the liner 90 is in the area "A" opposite the rotating elements 50 of the bark shredder 10 just above the fixed elements 40. This part of the liner 90 wears out quicker than the rest of the liner 90 because the rotating elements 50 fling bark directly out against the liner 90 in this area. When this small area becomes worn the liner 90 must be replaced. In the preferred embodiment the liner 90 is divided into a top liner annular ring 91 which fits into the top casing part 16 extending down to a join line 92 which is just above the area of maximum wear in the casing 11. A middle liner annular ring 93 shown in more detail in FIG. 3 extends down to the bottom edge of the top casing part 16. The middle annular ring 93 is formed in three annular ring sectors 94 which when joined form an annular ring. Holes 95 at each end of each sector 94, together with counter head screws, (not shown) are provided to retain each sector 94 in any one of three positions in the casing 11, and each sector 94 may be mounted either upwards or downwards, thus counting the reversed positions each sector 94 has six mounting positions in the casing 11. The height of the middle annular ring 93 is at least twice the height of the maximum wear area A, thus when one sector becomes worn in an area A then it can either be reversed, or moved to two other positions either reversed or the same way up. In this manner the life of the liner is considerably extended and new annular ring sectors 94 are only required after considerably longer use than existing bark shredders. A bottom liner annular ring 96 is provided in the bottom casing part 15. The bottom annular ring 96 has a cut out to match the outlet 22.

The top liner annular ring 91 and bottom liner annular ring 96 are preferably plug welded to the casing. A liner section is also attached to the service door 80 to complete the liner within the casing.

In one embodiment the rotor rotates at 750 rpm and the diameter of the extended tips of the rotating elements 50 is 4 ft. 9 ins. In another embodiment, the rotor has a rotation speed of 900 rpm and the diameter of the rotating elements 50 is 4 feet. In both cases the tip speed of the rotating elements is 10,800 ft. per minute. Tip speeds, diameter of the extended tips, number and size of rotating shredding elements 50 and fixed shredding elements 40 may all be varied to suit different conditions, including capacity of the unit, type of material to be shredded and other factors.

Figure 5:
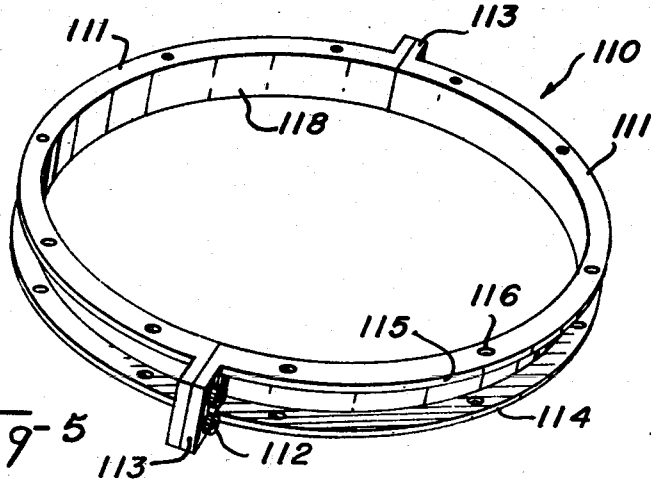
FIG. 5 is an isometric view of an intermediate casing section combined with an annular ring liner.
Figure 4:
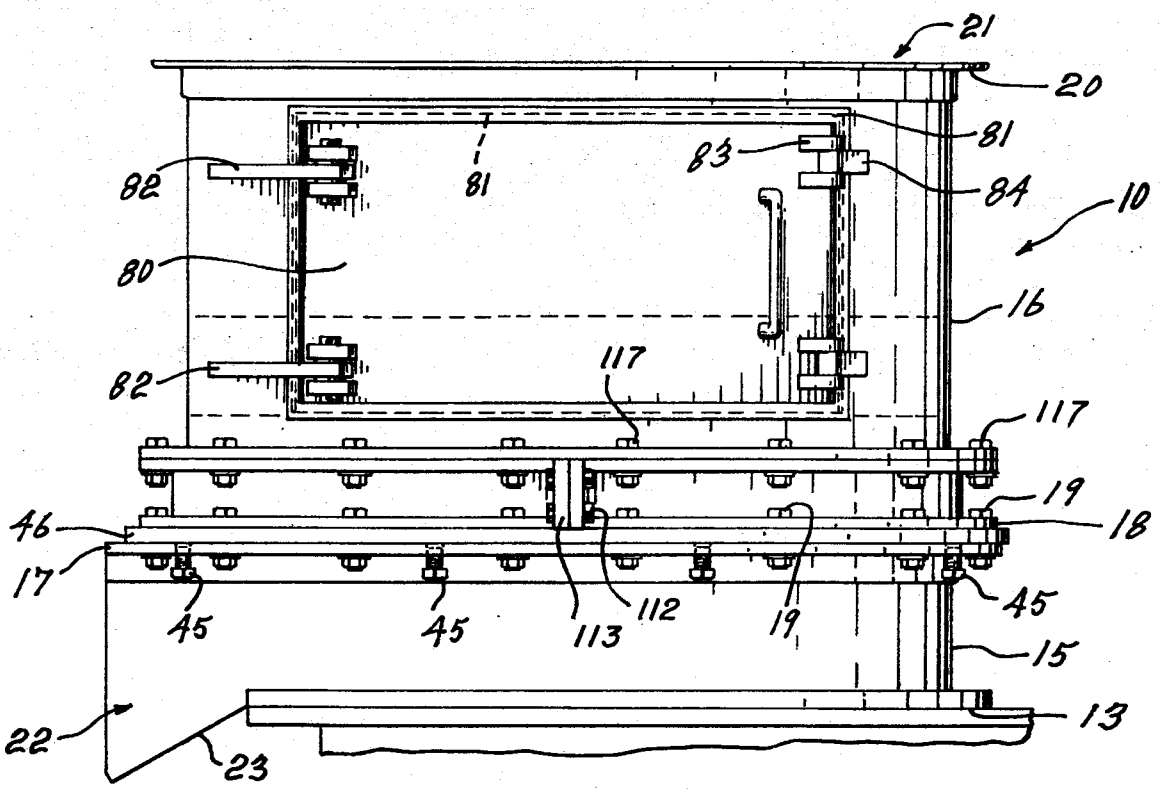
FIG. 4 is an elevation of another embodiment of a bark shredder of the present invention.

Another embodiment of the bark shredder is shown in FIGS. 4 and 5 wherein a central cylindrical casing section 110 is positioned between the upper casing section 16 and the lower casing section 15. The central cylindrical casing section 110 is split in two halves 111 and joined by bolts 112 through vertical flanges 113. The lower circumferential flange 114 of the central casing section 110 forms the flange to hold the fixed elements 40 between the upper casing section 16 and lower casing section 15. An upper circumferential flange 115 having a series of holes 116 for flange bolts 117 to locate and hold the central cylindrical casing section 110 between the upper casing section 16 and the lower casing section 15. The inside surface 118 of the central casing section 110 forms the liner and, in the embodiment shown, is integral with the casing. Thus when the casing section 110 is worn, it may be turned upside down and finally replaced. In a preferred embodiment, the upper casing section 16 may be independently supported from the top flange 20 thus allowing the central casing section 110 to be replaced without removing the upper casing section 16.

Figure 6:
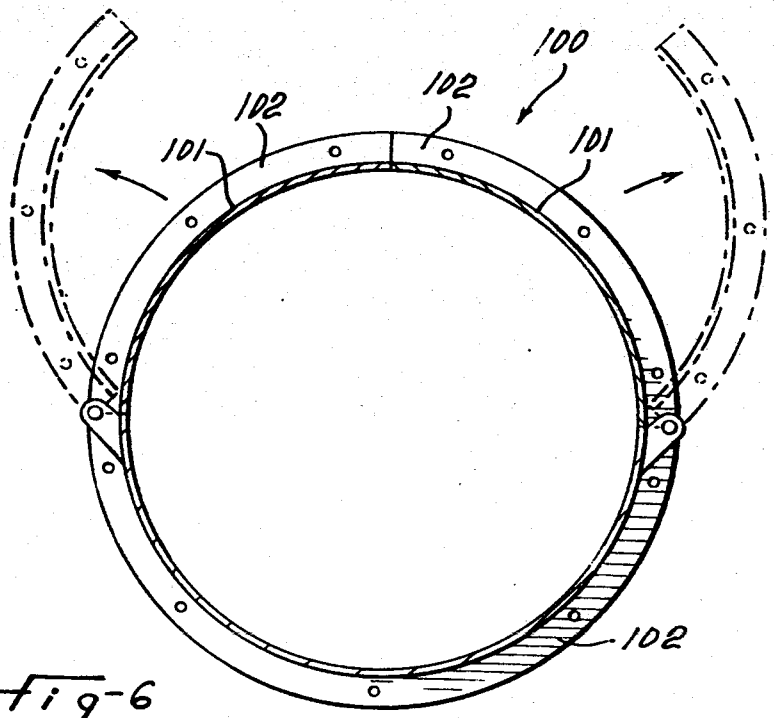
FIG. 6 is a horizontal cross section through the upper casing of another embodiment of a bark shredder showing two service doors.

Another embodiment of an upper casing section 100 is shown in FIG. 6 having two opening doors 101 each extending 90° around the circumference. The doors 101 include the flanges 102 at top and bottom and therefore by supporting the inlet duct independently and removing top and bottom flange bolts, the complete upper casing section 100 may be removed. Alternatively, the two doors allow a sufficiently large access space to replace the rotor in the bark shredder.

The liner, rotating elements and fixed elements may all be made of high abrasion resistant steel. Further changes may be made to the bark shredder described herein without departing from the scope of the present invention which is only limited by the claims.

The embodiments of the invention in which an exclusive property or privilege is claimed are defined as follows:

1. A bark shredder comprising a casing having a top tubular part and a bottom tubular part and means to detachably join the casing parts together, the casing defining a cylindrical working chamber, the chamber having a top inlet and a bottom symmetrical outlet, a rotor axially mounted in the chamber, a plurality of fixed shredding elements attached to the casing in a circle at one level of the chamber intermediate the inlet and outlet, the fixed shredding elements extending radially inwards from the casing into the chamber, means to detachably mount in the circle the fixed shredding elements between the two parts, a plurality of rotating shredding elements pivoted to the rotor in a circle and located above but adjacent to the fixed shredding elements, the rotating shredding elements extending radially outward from the rotor, the fixed and rotating shredding elements shaped to co-operate with each other to shred material in the chamber when the rotor is rotated in either direction.

2. The bark shredder as claimed in claim 1 wherein each of the fixed and rotating shredding elements is symmetrical about a line which extends radially from the longitudinal axis of the chamber.

3. The bark shredder as claimed in claim 1 or claim 2 wherein the placement and number of fixed shredding elements may be varied around the circle.

4. The bark shredder as claimed in claim 1 or claim 2 wherein adjacent fixed shredding elements are of different sizes.

5. The bark shredder as claimed in claim 1 or claim 2 wherein each of the fixed shredding elements comprises a generally isosceles triangular plate mounted to the casing by its base.

6. The bark shredder as claimed in claim 1 including jacking means to separate the casing parts for replacement of the fixed shredding elements.

7. The bark shredder as claimed in claim 6 wherein the jacking means comprises jack screws between the fixed shredding elements.

8. The bark shredder as claimed in claim 1 including a service opening in the top part of the casing, and a curved door on the top part of the casing for closing the opening.

9. The bark shredder as claimed in claim 8 wherein the curved door extends at least 90° around the cylindrical working chamber.

10. The bark shredder as claimed in claim 8 wherein the service opening extends around one half of the cylindrical working chamber, and two curved doors extend from top to bottom of the top part of the casing for closing the service opening, the top part of the casing being sideways removable from the bark shredder when the two doors are open.

11. The bark shredder as claimed in claim 1 including a wear liner mounted within the casing in the area of the shredding elements to protect the casing, the wear liner having a plurality of removable annular rings which are mounted in the casing.

12. The bark shredder as claimed in claim 11 wherein the liner has a top annular ring, a center annular ring and a bottom annular ring, and wherein the center annular ring is located at a location of maximum wear adjacent the shredding elements, the center annular ring being formed in a plurality of equal sectors which may be mounted either way up in the casing.

13. A bark shredder comprising a casing having a top tubular part having a wear liner therein, a center annular part having a wear surface therein located at a location of maximum wear adjacent the shredding elements, the center annular part formed in two semi-circular sections, and a bottom tubular part having a wear liner therein with means to detachably mount the fixed shredding elements between the center annular part and the bottom annular part, the casing defining a cylindrical working chamber, the chamber having a top inlet and a bottom symmetrical outlet, a rotor axially mounted in the chamber, a plurality of fixed shredding elements attached to the casing in a circle at one level of the chamber intermediate the inlet and outlet, the fixed shredding elements extending radially inwards from the casing into the chamber, a plurality of rotating shredding elements pivoted to the rotor in a circle and located above but adjacent to the fixed shredding elements, the rotating shredding elements extending radially outward from the rotor, the fixed and rotating shredding elements shaped to cooperate with each other to shred material in the chamber when the rotor is rotated in either direction.

* * * * *